US010600605B2

(12) United States Patent
Jeong et al.

(10) Patent No.: US 10,600,605 B2
(45) Date of Patent: Mar. 24, 2020

(54) APPARATUS FOR AGING FIELD EMISSION DEVICE AND AGING METHOD THEREOF

(71) Applicant: Electronics and Telecommunications Research Institute, Daejeon (KR)

(72) Inventors: Jin-Woo Jeong, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 16/123,540

(22) Filed: Sep. 6, 2018

(65) Prior Publication Data

US 2019/0080871 A1 Mar. 14, 2019

(30) Foreign Application Priority Data

Sep. 8, 2017 (KR) ..... 10-2017-0115465
Aug. 3, 2018 (KR) ..... 10-2018-0090958

(51) Int. Cl.
*H01J 9/44* (2006.01)
*H01J 29/04* (2006.01)
*H01J 9/42* (2006.01)

(52) U.S. Cl.
CPC ..... *H01J 9/445* (2013.01); *H01J 9/42* (2013.01); *H01J 29/04* (2013.01)

(58) Field of Classification Search
CPC ..... H01J 9/445; H01J 9/42; H01J 29/04
See application file for complete search history.

(56) References Cited

U.S. PATENT DOCUMENTS 5,730,634 A * 3/1998 Seko ..... G01R 31/25 445/3
7,973,742 B2 7/2011 Baik et al.
2004/0085306 A1* 5/2004 Moon ..... G09G 3/22 345/204
2004/0085307 A1* 5/2004 Moon ..... H01J 9/445 345/204
2004/0207575 A1* 10/2004 Moon ..... G09G 3/22 345/75.2
2008/0119104 A1* 5/2008 Baik ..... H01J 9/42 445/24

(Continued)

FOREIGN PATENT DOCUMENTS

KR 10-2006-0020288 A 3/2006
KR 10-2008-0033642 A 4/2008

*Primary Examiner* — Donald L Raleigh
(74) *Attorney, Agent, or Firm* — Rabin & Berdo, P.C.

(57) ABSTRACT

The inventive concept relates to an apparatus for aging a field emission device configured to emitting electrons based on an electric field between a first electrode and a second electrode, and an aging method thereof. The apparatus according to an embodiment of an inventive concept includes a voltage generator and a current controller. The voltage generator increases the voltage applied to the first electrode to the target voltage level during the first time. The current controller increases the field emission current for the second time to the target current level and increases the pulse width of the field emission current for the third time to the target pulse width. According to the inventive concept, the performance of a large field emission device may be improved with high efficiency and low cost.

17 Claims, 8 Drawing Sheets

(56) References Cited

U.S. PATENT DOCUMENTS

| | | | | |
|---|---|---|---|---|
| 2009/0179834 | A1* | 7/2009 | Tanaka | H01J 9/42 345/76 |
| 2015/0071413 | A1* | 3/2015 | Kim | H05G 1/32 378/207 |
| 2015/0216025 | A1 | 7/2015 | Jeong et al. | |
| 2016/0148776 | A1* | 5/2016 | Jeong | H01J 29/462 315/337 |

* cited by examiner

APPARATUS FOR AGING FIELD EMISSION DEVICE AND AGING METHOD THEREOF

CROSS-REFERENCE TO RELATED APPLICATIONS

This U.S. non-provisional patent application claims priority under 35 U.S.C. § 119 of Korean Patent Application Nos. 10-2017-0115465, filed on Sep. 8, 2017, and 10-2018-0090958, filed on Aug. 3, 2018, the entire contents of which are hereby incorporated by reference.

BACKGROUND

The present disclosure herein relates to an apparatus for testing a field emission device, and more particularly, to a field emission device aging apparatus and an aging method thereof.

A field emission device may refer to a device using a field emission effect that draws electrons from a metal surface by an electric field. The field emission device is generally composed of a bipolar structure including a cathode electrode and an anode electrode, or may be composed of a triode structure including a cathode electrode, an anode electrode, and a gate electrode for applying an electric field required for electron emission. The field emission device has advantages such as simple electrode structure, high-speed operation, and low power consumption, and may be applied to various electronic devices including display devices.

An emitter for emitting electrons by an electric field is formed on the cathode electrode of the field emission device. In order to ensure easiness of electron emission, the tip of the emitter may have a pointed shape, or nano-materials with elongated shapes may be used in the emitter. Due to such characteristics, the emitter of a field emission device has a more vulnerability to damage of the ambient vacuum decrease or arc discharge compared with the thermal electron emitter. Therefore, a seasoning or aging process may be required for stable performance of the field emission device.

The aging process may be a step of preserving the field emission device until it is stabilized by applying appropriate stress to the field emission device for a certain period of time. There is a demand for an aging process for mass production of a field emission device at low cost and high efficiency. In addition, there is a demand for an aging device for efficiently performing the aging process.

SUMMARY

The present disclosure to an apparatus for aging a field emission device and an aging method thereof, which may efficiently perform a large amount of aging at a low cost by optimizing steps for aging a field emission device.

An embodiment of the inventive concept provides an apparatus for aging a field emission device configured to emit electrons based on an electric field between a first electrode and a second electrode. The apparatus includes: a voltage generator configured to increase a magnitude of a voltage applied to the first electrode of the field emission device to a target voltage level during a first time; and a current controller configured to increase the magnitude of the field emission current of the field emission device to the target current level during a second time after the first time and increase a pulse width of the field emission current having the target current level to a target pulse width during a third time after the second time.

In an embodiment, the voltage generator may further generate a gate voltage applied to a gate electrode of the field emission device for adjusting an electron emission amount after the first time.

In an embodiment, the voltage generator may short-circuit the second electrode and the gate electrode during the first time, and the first electrode may be an anode electrode, and the second electrode may be a cathode electrode.

In an embodiment, the voltage generator may short-circuit the first electrode and the gate electrode during the first time, and the first electrode may be a cathode electrode, and the second electrode may be an anode electrode.

In an embodiment, the current controller may interrupt a flow of the field emission current during the first time and control the field emission current to have an initial aging pulse width less than the target pulse width and have a peak value that increases to the target current level during the second time.

In an embodiment, the current controller may increase the pulse width of the field emission current in a logarithm scale from the initial aging pulse width to the target pulse width during the third time.

In an embodiment, the current controller may increase a peak value of the field emission current to the target current level during the second time and control the field emission current such that the peak value is repeated at least once at the same magnitude.

In an embodiment, the current controller may increase the pulse width of the field emission current to the target pulse width during the third time and control the field emission current so that the pulse width is repeated at least once at the same magnitude.

In an embodiment, the voltage generator may apply the voltage having the target voltage level to the first electrode during a fourth time after the third time, and the current controller may control the field emission current so that the peak value is maintained at the target current level and a pulse width is maintained at the target pulse width during the fourth time.

In an embodiment, the current controller may include: a first transistor configured to determine a pulse width of the field emission current based on a first control signal; a second transistor configured to determine a peak value of the field emission current based on a second control signal; a function generator configured to provide the first control signal to a gate of the first transistor and to provide the second control signal to a gate of the second transistor; and a current measurer configured to measure the field emission current.

In an embodiment, the device may further include an aging controller for controlling the voltage generator and the current controller, wherein the aging controller may control the voltage generator to sequentially increases the magnitude of the voltage applied to the first electrode to the target voltage level for the first time and to maintain the target voltage level after the first time; and control the current controller to sequentially increase the peak value of the field emission current to the target current level during the second time, control the current controller to sequentially increase the pulse width of the field emission current to the target pulse width during the third time, and control the current controller to have the peak value of the target current level and to have the target pulse width during the fourth time after the third time.

In an embodiment, the device may further include: a second current controller for controlling a second field emission current of a second field emission device that emits electrons based on an electric field between a third electrode and a fourth electrode, increasing the magnitude of the second field emission current to the target current level during the second time, and increasing the pulse width of the second emission current to the target pulse width during the third time; and a second aging controller for controlling the second current controller, wherein the voltage generator may increase a magnitude of a voltage applied to the third electrode to the target voltage level during the first time.

In an embodiment, the device may further include an integration controller for determining a control variable of the aging controller and the second aging controller based on the field emission current, the second field emission current, and the voltage applied to the first and third electrodes, wherein the aging controller and the second aging controller may determine a magnitude and a pulse width of each of the field emission current and the second field emission current based on the control variable.

In an embodiment of the inventive concept, a method of aging a field emission device includes: sequentially increasing a voltage applied to a first electrode of the field emission device to a target voltage level during a first time; maintaining the voltage at the target voltage level after the first time; sequentially increasing a field emission current of the field emission device to a target current level during a second time after the first time; sequentially increasing a pulse width of the field emission current having the target current level to a target pulse width during a third time after the second time; and controlling the field emission current to maintain the target current level and the target pulse width during a fourth time after the third time.

In an embodiment, sequentially increasing the voltage to the target voltage level may include: short-circuiting the second electrode and the gate electrode of the field emission device; increasing the voltage by a reference voltage level; and determining whether the voltage reaches the target voltage level.

In an embodiment, sequentially increasing the field emission current to the target current level may include: electrically isolating the second electrode from the gate electrode; increasing a peak value of the field emission current by a reference current level; and determining whether the field emission current reaches the target current level.

In an embodiment, sequentially increasing the pulse width of the field emission current to the target pulse width may include: increasing the pulse width by a reference width; and determining whether the pulse width reaches the target pulse width.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

In the following, embodiments of the inventive concept will be described in detail so that those skilled in the art easily carry out the inventive concept.

Figure 1:
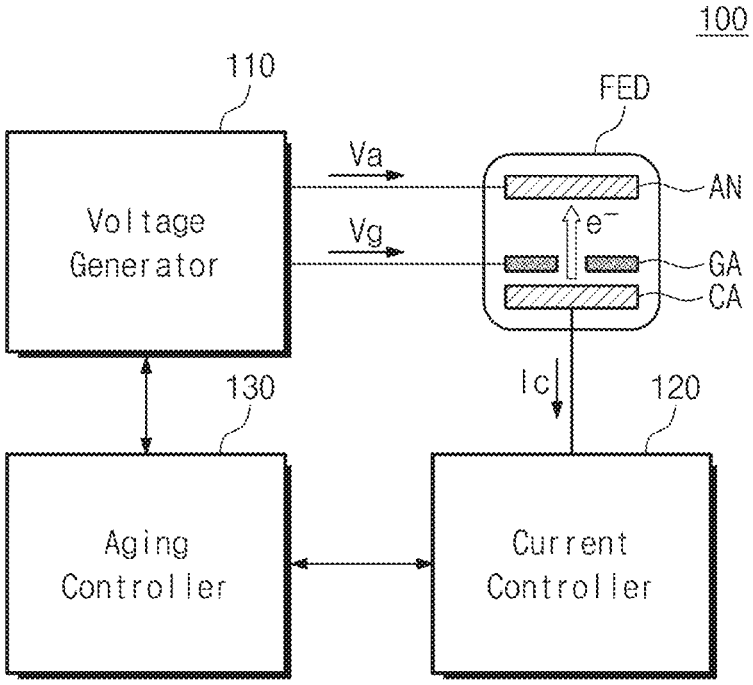
FIG. 1 is a block diagram of a field emission device aging apparatus according to an embodiment of the inventive concept.

FIG. 1 is a block diagram of a field emission device aging apparatus according to an embodiment of the inventive concept. Referring to FIG. 1, a field emission device aging apparatus 100 includes a voltage generator 110, a current controller 120, and an aging controller 130. The field emission device aging apparatus 100 performs aging to stabilize the performance of the field emission device FED. The field emission device aging apparatus 100 performs four-step aging for the field emission device FED including voltage aging, field emission current aging, field emission time aging, and final condition aging, and specific four-step aging is described below.

The field emission device FED includes an anode electrode AN, a cathode electrode CA, and a gate electrode GA. The cathode electrode CA is configured to emit electrons based on an electric field applied to the field emission device FED. For this, an emitter may be formed on the cathode electrode CA, which includes a nanomaterial having a pointed shape or an elongated shape. The anode electrode AN is configured to receive electrons emitted from the cathode electrode CA. The gate electrode GA is configured to apply an electric field for electron emission between the cathode electrode CA and the anode electrode AN. The gate electrode GA may be disposed between the cathode electrode CA and the anode electrode AN. The field emission device FED may further include a sealing container for receiving the anode electrode AN, the cathode electrode CA, and the gate electrode GA, and the inside of the sealed container may have a high degree of vacuum in order to prevent damage to the electrodes.

The field emission device FED having a three-electrode structure including the anode electrode AN, the cathode electrode CA, and the gate electrode GA may independently control electron emission amount and electron energy through the gate electrode GA and the anode electrode AN. The voltage applied to the anode electrode AN may be higher than the voltage applied to the gate electrode GA, and in this case, the emitted electrons are accelerated, and the kinetic energy based on the accelerated electrons may be converted into various energies. Kinetic energy may be transformed into various forms such as infrared ray, visible ray, UV-ray, terah ray, radio ray, x-ray, or gamma ray. Using this, the field emission device FED may be used for a field emission display, a field emission lamp, an X-ray source, and an RF device.

The voltage generator 110 may generate the anode voltage Va applied to the anode electrode AN of the field emission device FED. The anode voltage Va may be provided for voltage aging of the field emission device FED. The emitter of the field emission device FED is susceptible to arc discharge, in which part of the electrode material evaporates and becomes a gas. If abnormal charges accumulate in a specific area inside the field emission device FED and exceed the threshold potential, the arc discharge is generated by the breakdown of the insulation state. The accumulation of unnecessary charges in the design and fabrication stages of the field emission device FED will be considered, but arc discharge may occur due to fine protrusions existing on the surface of the electrode or the insulating material. The anode voltage Va may be applied to the anode electrode AN to remove these fine protrusions.

The voltage generator 110 may generate the anode voltage Va that sequentially increases to a target voltage level for voltage aging. Here, the target voltage level may be a predetermined voltage level according to the driving condition of the field emission device FED. In order to increase the effect of aging, the target voltage level may be higher than the level of the anode voltage for the actual operation of the field emission device FED but may be lower than the threshold voltage level causing permanent damage to the field emission device FED. For example, the voltage generator 110 may increase the level of the anode voltage Va sequentially from zero to the target voltage level during the voltage aging. The anode voltage Va may intentionally cause an arc discharge. Within a range that does not cause permanent damage to the field emission device FED due to excessive arc discharge, the voltage generator 110 may sequentially increase the level of the anode voltage Va.

The voltage generator 110 may maintain the level of the anode voltage Va that reaches the target voltage level after voltage aging. In the field emission current aging, the field emission time aging, and the final condition aging described later after the voltage aging, in order to receive the emitted electrons, the anode voltage Va may be maintained at the target voltage level. That is, for later aging, the burden of separately adjusting the voltage level of the anode voltage Va may be alleviated.

The voltage generator 110 may generate a gate voltage Vg applied to the gate electrode GA of the field emission device FED. The gate voltage Vg may be provided to generate an electric field for emitting electrons from the field emission device FED. In aging steps after voltage aging, field emission current is generated in the field emission device FED, and the voltage generator 110 may generate the gate voltage Vg so that the field emission current is generated. The voltage generator 110 generates a gate voltage Vg having a voltage level lower than the anode voltage Va. However, in the voltage aging step, the voltage generator 110 may not generate the gate voltage Vg so that a field emission current is not generated.

The current controller 120 controls the field emission current Ic generated in the field emission device FED. For this purpose, the current controller 120 may be electrically connected to the cathode electrode CA of the field emission device FED. The field emission current Ic may be provided for field emission current aging and field emission time aging of the field emission device FED. The emitter formed on the cathode electrode CA is sensitive to the vacuum degree drop due to the above-described structural features. When electrons are emitted and proceed to the anode electrode AN, gaseous elements existing on the path of electrons may be ionized based on collision with electrons. Ions having a positive electric charge proceed to the cathode electrode CA. When the ions reach the emitter and collide with the accelerated energy, the emitter may be damaged and the field emission characteristic may be reduced. That is, since there are many gaseous elements, there is a high possibility that damage to the emitter occurs in a state where the degree of vacuum is low. The current controller 120 may control the field emission current Ic to prevent damage to the emitter.

The current controller 120 may control the field emission current Ic so as to sequentially increase to the target current level for field emission current aging of the field emission device FED. Here, the target current level may be a current level of a predetermined field emission current Ic according to driving conditions of the field emission device FED. In order to increase the effect of aging, the target current level may be higher than the level of the field emission current for the actual operation of the field emission device FED, but may be lower than the limiting current level causing permanent damage to the field emission device FED. For example, the current controller 120 may increase the peak value of the field emission current Ic sequentially from zero to the target current level during the field emission current aging. The field emission current Ic may prevent vacuum degree drop by gradually removing the positive charge of the field emission device FED. At this time, the field emission current Ic may have a constant pulse width.

The current controller 120 may control the field emission current Ic so as to sequentially increase to the target pulse width for the field emission time aging. Here, the target pulse width may be a pulse width of a predetermined field emission current Ic according to driving conditions of the field emission device FED. To increase the aging effect, the target pulse width may be greater than the pulse width of the field emission device for the actual driving of the field emission device FED. The current controller 120 increases the pulse width of the field emission current Ic, and ages the field emission device FED so that the field emission device FED stably emits electrons during the final required time. For example, the current controller 120 may increase the pulse width of the field emission current Ic sequentially from the pulse width during the field emission current aging to the target pulse width during the field emission time aging. At this time, the field emission current Ic may have a target current level. That is, the burden of separately adjusting the current level of the field emission current Ic may be alleviated.

The current controller 120 may determine the field emission current Ic for final condition aging after field emission current aging and field emission time aging. During final condition aging, the field emission current Ic may have a target current level and a target pulse width. That is, the current controller 120 maintains the current level and the pulse width of the field emission current Ic constant from previous aging steps, thereby reducing the burden of separately adjusting the current level and the pulse width of the field emission current Ic.

The aging controller 130 may control the voltage generator 110 and the current controller 120 to perform the aging of the field emission device FED. The aging controller 130 may control the voltage generator 110 during the voltage aging such that the level of the anode voltage Va is sequentially increased to the target voltage level. The aging controller 130 may control the current controller 120 so that the level of the field emission current Ic is sequentially increased to the target current level during the field emission current aging. The aging controller 130 may control the current controller 120 so that the pulse width of the field emission current Ic is sequentially increased to the target pulse width during the field emission time aging. During final condition aging, the aging controller 130 may control the voltage generator 110 so that the anode voltage Va is maintained at the target voltage level, and may control the current controller 120 such that the field emission current Ic is maintained at the target current level and the target pulse width.

The aging controller 130 may control the operation time of voltage aging, field emission current aging, field emission time aging, and final condition aging. For example, the aging controller 130 may measure the level of the anode voltage Va and determine whether the level of the anode voltage Va reaches the target voltage level. When the level of the anode voltage Va reaches the target voltage level, the aging controller 130 may control the current controller 120 to terminate voltage aging and to perform field emission current aging. The aging controller 130 may measure the level of the field emission current Ic and determine whether the level of the field emission current Ic reaches the target current level. When the level of the field emission current Ic reaches the target current level, the aging controller 130 may control the current controller 120 to terminate the field emission current aging and perform field emission time aging.

The aging controller 130 may function as a central processing unit of the field emission device aging apparatus 100. For example, the aging controller 130 may be implemented using a computing device. The aging controller 130 may include a CPU for processing information on the measured anode voltage Va, gate voltage Vg, and field emission current Ic and information for performing various aging operations, a memory for storing such information, and a bus for delivering information between the CPU and memory. The CPU may operate by utilizing an operation space of the memory, and according to the control of the CPU, the voltage generator 110 and the current controller 120 may perform various aging operations. For example, the aging controller 130 may be implemented using a single board computer, such as Arduino, Raspberry Pie, or the like.

Figure 2:
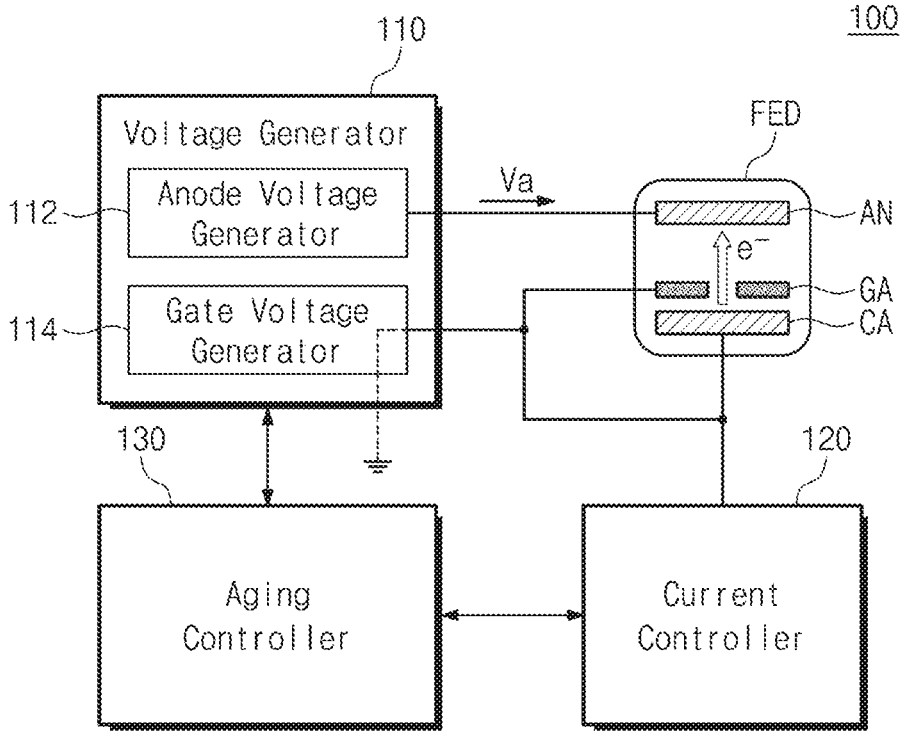
FIG. 2 is a block diagram illustrating a voltage aging operation of the field emission device of FIG. 1.

FIG. 2 is a block diagram illustrating a voltage aging operation of the field emission device of FIG. 1. Referring to FIG. 2, the field emission device aging apparatus 100 includes a voltage generator 110, a current controller 120, and an aging controller 130. The voltage generator 110, the current controller 120, and the aging controller 130 of FIG. 2 correspond to the voltage generator 110, the current controller 120, and the aging controller 130 of FIG. 1. Also, the field emission device FED corresponds to the field emission device FED of FIG. 1.

The voltage generator 110 includes an anode voltage generator 112 and a gate voltage generator 114. The anode voltage generator 112 generates the anode voltage Va applied to the anode electrode AN of the field emission device FED. The gate voltage generator 114 generates a gate voltage (Vg in FIG. 1) applied to the gate electrode GA of the field emission device FED. The anode voltage generator 112 and the gate voltage generator 114 generate voltages applied to the field emission device FED under the control of the aging controller 130.

The anode voltage generator 112 generates an anode voltage Va that sequentially increases to a target voltage level for voltage aging which intentionally causes an arc discharge. The anode voltage generator 112 may be electrically connected to the anode electrode AN and the anode voltage Va may be provided to the anode electrode AN. Thereafter, in the steps of the field emission current aging, the field emission time aging, and the operation condition aging, the anode voltage generator 112 may provide an anode voltage Va having a target voltage level to the anode electrode AN. At this time, the anode voltage Va may be a DC voltage, but is not limited thereto. For example, the anode voltage Va may be a voltage with a pulse having a peak value of the target voltage level.

For voltage aging, the gate voltage generator 114 may control the cathode electrode CA and the gate electrode GA to be short-circuited. In the voltage aging step, even if an arc discharge is generated by the anode voltage Va, since the gate electrode GA is disposed between the anode electrode AN and the cathode electrode CA, arc discharge is hardly generated directly in the emitter formed on the cathode electrode CA. When the discharged electric charges proceed toward the gate electrode GA or the cathode electrode CA, the voltage between the gate electrode GA and the cathode electrode CA may be instantaneously increased. If the increased voltage has a level higher than the threshold voltage of the emitter, the emitter may be damaged. Therefore, the voltage aging may be performed so that the gate electrode GA and the cathode electrode CA are short-circuited so as to have the same potential and the potential difference between the anode electrode AN and the cathode electrode CA or between the anode electrode AN and the gate electrode GA is increased.

For voltage aging, the cathode electrode CA and the gate electrode GA may be grounded. It is described with reference to FIG. 2 that the cathode electrode CA and the gate electrode GA are short-circuited and grounded by the gate voltage generator 114, but the inventive concept is not limited thereto. For example, the cathode electrode CA and the gate electrode GA may be short-circuited and grounded during voltage aging, based on a separate switch. Such short-circuiting and grounding may be performed under the control of the aging controller 130.

Also, unlike that shown in FIG. 2, the cathode electrode CA and the gate electrode GA may be short-circuited but not grounded and the negative voltage may be applied to the short-circuited cathode electrode CA and gate electrode GA. In this case, the gate voltage generator 114 may generate a negative voltage to be applied to the short-circuited cathode electrode CA and gate electrode GA. The gate voltage generator 114 may generate a gate voltage sequentially increasing to a negative target voltage level and provide it to the cathode electrode CA and the gate electrode GA. Herein, the increase will be understood to mean an increase in magnitude of the absolute value of the voltage level. In this case, the anode voltage generator 112 may not generate the anode voltage Va, and the anode electrode AN may be grounded. As a result, the potential difference between the anode electrode AN and the cathode electrode CA or between the anode electrode AN and the gate electrode GA may sequentially increase.

Unlike this, the anode voltage generator 112 applies a positive anode voltage Va to the anode electrode AN and the gate voltage generator 114 applies a negative gate voltage to the gate electrode GA and the cathode electrode CA. In this case, the anode voltage Va may sequentially increase to a positive target voltage level or the gate voltage may sequentially increase to a negative target voltage level. In the same manner, herein, the increase will be understood to mean an increase in magnitude of the absolute value of the voltage level. The field emission device FED may be a bipolar structure including a cathode electrode CA and an anode electrode AN. In this case, the anode voltage generator 112 may sequentially apply an increasing anode voltage Va to the anode electrode AN and the cathode electrode CA may be grounded. In the case of a bipolar structure, the emitter may be formed in a region farther from the anode electrode AN than the surface of the cathode electrode CA.

During the voltage aging, the field emission current may not be generated. The current controller 120 may control the field emission device FED under the control of the aging controller 130 so that a field emission current is not generated.

Figure 3:
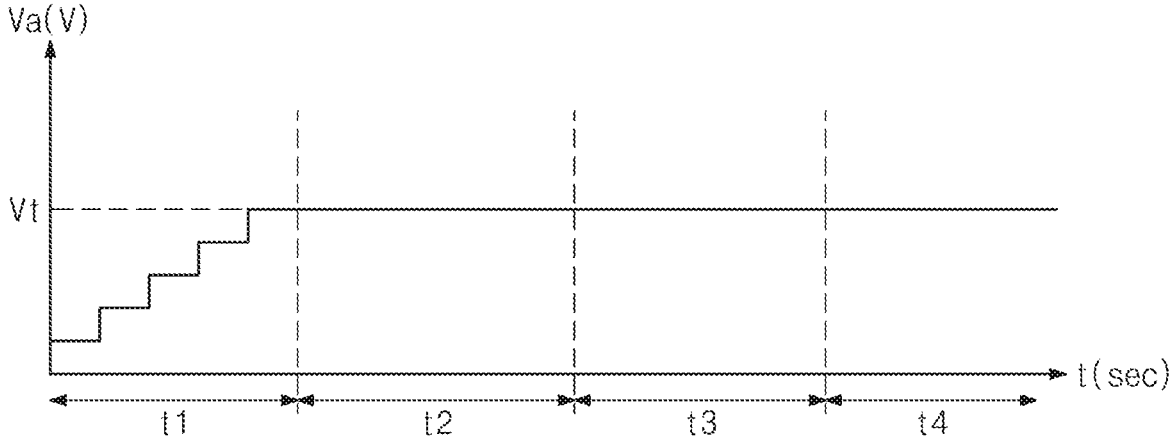
FIG. 3 is a graph illustrating anode voltages generated by the voltage generator of FIG. 2.

FIG. 3 is a graph illustrating anode voltages generated by the voltage generator of FIG. 2. The horizontal axis is defined as time, and the vertical axis is defined as the magnitude of the anode voltage Va. The time may be divided into first to fourth times t1 to t4. The first time t1 is defined as a time for performing the voltage aging. The second time t2 is defined as a time for performing the field emission current aging. The third time t3 is defined as a time for performing the field emission time aging. The fourth time t4 is defined as a time for performing the final condition aging. For convenience of explanation, referring to the reference numerals of FIG. 2, FIG. 3 will be described.

During the first time t1, the anode voltage Va sequentially increases to the target voltage level Vt. The anode voltage Va may be generated at the anode voltage generator 112. Illustratively, the anode voltage Va may increase sequentially from zero to the target voltage level Vt. The anode voltage Va may show a stepped waveform in which the same voltage level (DC voltage) is maintained for a certain period of time, increased by the reference voltage level, and then maintained at the same voltage level for a certain period of time. Here, the reference voltage level may be within a reference range that does not cause permanent damage to the field emission device FED. Unlike those shown, the anode voltage Va may not show a stepped waveform. For example, the anode voltage Va may be linearly increased over time.

During the second time to the fourth time period t2 to t4, the anode voltage Va may be maintained at the target voltage level Vt. By the anode voltage Va maintained at the target voltage level Vt, electrons emitted from the cathode electrode CA may be provided to the anode electrode AN, and a field emission current may be generated. That is, the anode voltage Va that reaches the target voltage level Vt for the first time t1 may be maintained without any additional voltage regulation by the aging controller 130, and the burden of the voltage regulation may be alleviated.

The first to fourth times t1 to t4 shown in FIG. 3 are shown to have arbitrary length for convenience of explanation, and it is to be understood that, depending on the progress of each aging step, the lengths of the first to fourth times t1 to t4 may be different. Also, the level of the anode voltage Va which increases stepwise by the reference voltage level during the first time t1 is shown for convenience of explanation, and depending on the control of the aging controller 130, the magnitude of the reference voltage level may be different. Further, during voltage aging, when the level of the gate voltage applied to the cathode electrode CA and the gate electrode GA sequentially increases by the negative target voltage level, the anode voltage Va may be maintained at zero.

Figure 4:
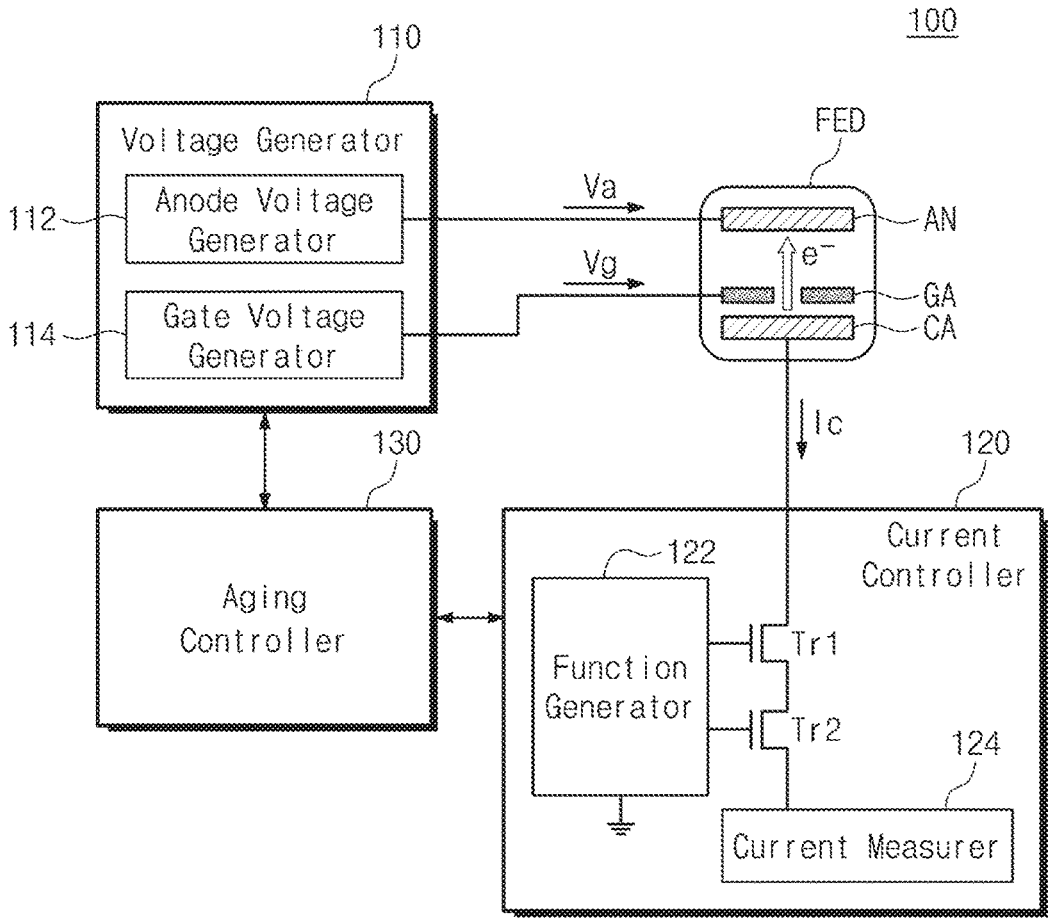
FIG. 4 is a block diagram for explaining a field emission current aging operation, a field emission time aging operation, and a final condition aging operation of the field emission device aging apparatus of FIG. 1.

FIG. 4 is a block diagram for explaining a field emission current aging operation, a field emission time aging operation, and a final condition aging operation of the field emission device aging apparatus of FIG. 1. Referring to FIG. 4, the field emission device aging apparatus 100 includes a voltage generator 110, a current controller 120, and an aging controller 130. The voltage generator 110, the current controller 120, and the aging controller 130 of FIG. 4 correspond to the voltage generator 110, the current controller 120, and the aging controller 130 of FIG. 1 or 2. Also, the field emission device FED corresponds to the field emission device FED of FIG. 1 or 2.

The voltage generator 110 includes an anode voltage generator 112 and a gate voltage generator 114. The anode voltage generator 112 and the gate voltage generator 114 respectively correspond to the anode voltage generator 112 and the gate voltage generator 114 of FIG. 2. The anode voltage generator 112 applies to the anode electrode AN the anode voltage Va that reaches the target voltage level during the voltage aging.

The gate voltage generator 114 generates a gate voltage Vg having a voltage level lower than the anode voltage Va. The gate voltage generator 114 applies the gate voltage Vg to the gate electrode GA. After the voltage aging, in order to generate the field emission current Ic, the gate electrode GA and the cathode electrode CA are electrically separated. During field emission current aging, field emission time aging, and final condition aging, the gate voltage generator 114 may apply a gate voltage Vg having a constant voltage level to the gate electrode GA. The gate voltage Vg may be a DC voltage like the anode voltage Va, but is not limited thereto.

The current controller 120 may include a first transistor Tr1, a second transistor Tr2, a function generator 122, and a current measurer 124. The structure of the current controller 120 of FIG. 4 is exemplary, and the embodiment of the inventive concept is not limited to the structure of FIG. 4. The current controller 120 operates to interrupt the flow of the field emission current Ic during the voltage aging. After voltage aging, the current controller 120 controls the level or pulse width of the field emission current Ic during field emission current aging, field emission time aging, and final condition aging.

The first transistor Tr1 may determine the flow or pulse width (period and duty) of the field emission current Ic. The first transistor Tr1 may control the field emission current Ic based on the first control signal generated from the function generator 122. For example, when the first control signal of high level is provided to the gate of the first transistor Tr1, the first transistor Tr1 may be turned on, and the field emission current Ic may be generated. When the first control signal of the low level is provided to the gate of the first transistor Tr1, the first transistor Tr1 may be turned off and the flow of the field emission current Ic may be cut off. That is, the pulse width of the field emission current Ic may be determined depending on the pulse width of the first control signal.

The first transistor Tr1 may be a metal oxide semiconductor field effect transistor (MOSFET), for example, but it is not limited thereto and may include various transistor elements. For example, the drain of the first transistor Tr1 is connected to the cathode electrode CA, the source is connected to the drain of the second transistor Tr2, and the gate receives the first control signal from the function generator 122. The first transistor Tr1 may include a withstand voltage element capable of coping with a voltage change of the cathode electrode CA.

The second transistor Tr2 may determine the level or the peak value of the field emission current Ic. The second transistor Tr2 may control the field emission current Ic based on the second control signal generated from the function generator 122. For example, when the first transistor Tr1 is turned on, the second transistor Tr2 may adjust the level of the field emission current Ic based on the magnitude of the second control signal.

The second transistor Tr2 may be a metal oxide semiconductor field effect transistor (MOSFET), for example, but it is not limited thereto and may include various transistor elements. For example, the drain of the second transistor Tr2 is connected to the source of the first transistor Tr1, the source is connected to the current measurer 124, and the gate receives the second control signal of the function generator 122. Since the second transistor Tr2 is not directly connected to the field emission device FED, it may not be constituted as a withstand voltage element.

The function generator 122 generates a first control signal and a second control signal. The first control signal provides a gate-source voltage to the first transistor Tr1 to determine the pulse width of the field emission current Ic. The second control signal provides a gate-source voltage to the second transistor Tr2 to determine the level of the field emission current Ic. Illustratively, the function generator 122 may directly generate the first and second control signals under the control of the aging controller 130. Illustratively, the function generator 122 may generate a first control signal and modulate the amplitude of the first control signal to generate a second control signal. Illustratively, the function generator 122 may receive the pulse width modulation signal from the aging controller 130. The function generator 122 may generate the second control signal by using the pulse width modulation signal as the first control signal and modulate the amplitude of the pulse width modulation signal to generate a second control signal.

The current measurer 124 may measure the field emission current Ic flowing through the first transistor Tr1 and the second transistor Tr2. Illustratively, the current measurer 124 may include an oscilloscope that displays the waveform of the field emission current Ic. The current measurer 124 may transmit information on the measured field emission current Ic to the aging controller 130. The aging controller 130 may determine whether to maintain the current aging state and control the voltage generator 110 or the current controller 120 based on the measured field emission current Ic.

Figure 5:
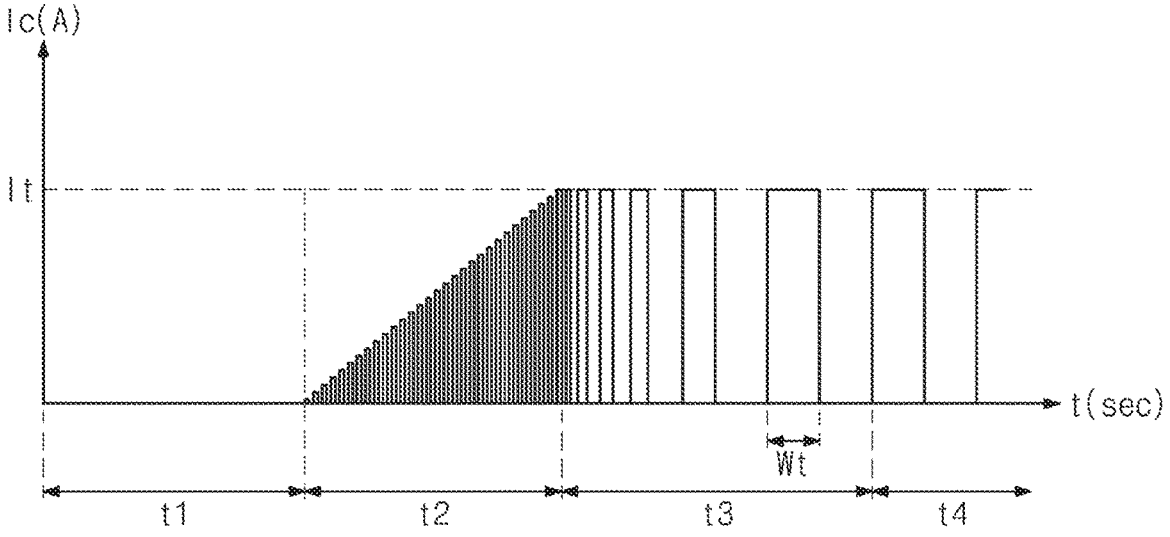
FIG. 5 is a graph showing field emission currents generated by the current controller of FIG. 4.

FIG. 5 is a graph showing field emission currents generated by the current controller of FIG. 4. The horizontal axis is defined as a time, and the vertical axis is defined as the magnitude of the field emission current Ic. The time may be divided into first to fourth times t1 to t4. The first time t1 is defined as the time for performing the voltage aging. The second time t2 is defined as a time for performing the field emission current aging. The third time t3 is defined as a time for performing the field emission time aging. The fourth time t4 is defined as a time for performing the final condition aging. For convenience of explanation, referring to the reference numerals of FIG. 4, FIG. 5 will be described.

During the first time t1, the flow of the field emission current Ic is interrupted. For example, the function generator 122 may not generate a pulse, and the first transistor Tr1 and the second transistor Tr2 may be off. At the same time, the gate electrode GA and the cathode electrode CA of the field emission device FED may be shorted to each other, and the anode voltage generator 112 may generate an anode voltage Va that sequentially increases to the target voltage level.

During the second time t2, the field emission current Ic sequentially increases to the target current level It. Illustratively, the peak value of the field emission current Ic may increase sequentially from zero to the target current level It while maintaining a constant pulse width (initial aging pulse width). Illustratively, the constant pulse width may correspond to the smallest pulse width of the pulse generated in the function generator 122, but is not limited thereto. In addition, unlike those shown in FIG. 5, the waveform of the field emission current Ic may be increased stepwise or linearly to the target current level It. The field emission current Ic may have a peak value for a predetermined time after the rising edge and a peak value increased by the reference current level after the next rising edge. Here, the reference current level may be within a reference range that does not cause permanent damage of the emitter.

During the second time t2, the first transistor Tr1 may be periodically turned on and off based on the first control signal generated from the function generator 122. The first control signal may maintain a predetermined period. The second transistor Tr2 may control the field emission current Ic to have a sequentially increasing peak value based on a second control signal that changes with time generated from the function generator 122. When the second time t2 is started, the gate electrode GA and the cathode electrode CA may be electrically separated from each other. The anode voltage generator 112 may generate the anode voltage Va having the target voltage level and the gate voltage generator 114 may generate the gate voltage Vg lower than the target voltage level.

During the third time t3, the field emission current Ic may have a pulse width that increases sequentially to the target pulse width Wt. Illustratively, the field emission current Ic may have a pulse width sequentially increasing from the pulse width of the field emission current Ic of the second time t2 to the target pulse width Wt while maintaining the peak value of the target current level. The field emission current Ic may be maintained at the target current level for a certain time after the rising edge and may be maintained at the target current level for a time increased by the reference width after the next rising edge. Here, the reference width may be within a reference range that does not cause permanent damage to the field emission device FED.

During field emission time aging, since there is a high possibility that damage due to aging occurs at an early stage, the pulse width may be increased in a logarithmic manner in which the variation of the pulse width is increased with the passage of time. However, the pulse width may be increased in various ways such as a linear function, a quadratic function, and the like. Further, FIG. 5 shows that the duty of the field emission current Ic is constant, but the inventive concept is not limited thereto and the duty of the field emission current Ic may be changed. In addition, unlike FIG. 5, the period of the field emission current Ic may be kept constant as long as the pulse width of the field emission current Ic sequentially increases.

During the third time t3, the first transistor Tr1 may be turned on and off based on the first control signal. The pulse width of the first control signal may increase with time. The second transistor Tr2 may control the field emission current Ic so as to have a peak value of the target current level It based on the second control signal that maintains a constant magnitude. The anode voltage generator 112 and the gate voltage generator 114 may generate the anode voltage Va and gate voltage Vg identical to those in the second time t2.

During the fourth time t4, the field emission current Ic may have a peak value of the target current level It and have the target pulse width Wt. At the same time, the anode voltage generator 112 and the gate voltage generator 114 may generate the anode voltage Va and gate voltage Vg identical to those in the second time t2. During the fourth time t4, when the field emission current Ic measured by the current measuring device 124 decreases or an arc discharge occurs, the aging controller 130 may repeat the voltage aging, the field emission current aging, and the field emission time aging again or determine it as a failure. As shown in FIG. 5, during the fourth time t4, the field emission device aging apparatus 100 may change at least one of a voltage applied to the field emission device FED, a level of the field emission current Ic, and a pulse width of the field emission current Ic. For example, the current controller 120 may adjust the level of the field emission current Ic and the pulse width of the field emission current Ic to a condition for driving the actual field emission device FED.

Figure 6:
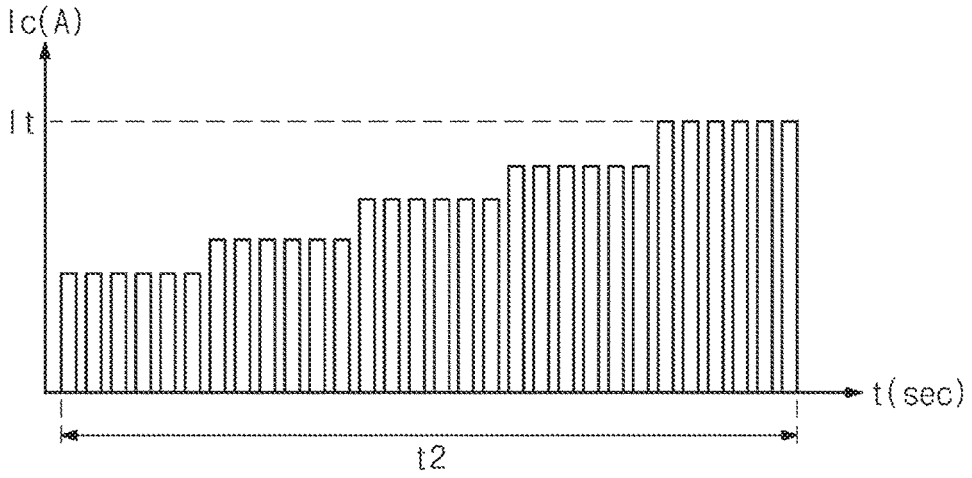
FIG. 6 is a graph showing another embodiment of the field emission current generated during the second time of FIG. 5.

FIG. 6 is a graph showing another embodiment of the field emission current generated during the second time of FIG. 5. The horizontal axis is defined as a time, and the vertical axis is defined as the magnitude of the field emission current Ic. Referring to FIG. 6, the peak value of the field emission current Ic may sequentially increase from 0 to the target current level It during the second time t2. However, unlike FIG. 5, the peak value of the field emission current Ic may be repeatedly maintained at the same current level for a constant time (reference time). For example, even if the current level of the field emission current Ic is increased by the reference current level thereafter, the reference time may be sufficient time to ensure that the field emission device (FED) is not permanently broken.

The peak value of the field emission current Ic may be increased by the first reference current level after maintaining the same current level for a predetermined time. Here, the first reference current level may be larger than the reference current level in FIG. 5. After the peak value of the field emission current Ic is increased by the first reference current level, the peak value of the field emission current Ic may be maintained again for a predetermined time and increased again by the second reference current level. That is, the peak value may increase stepwise to the target current level It. The first reference current level and the second reference current level may be equal to each other, but the inventive concept is not limited thereto, and may be set to different sizes in consideration of the possibility of permanent damage of the field emission device FED. In addition, unlike FIG. 6, the reference time at which the peak value of the field emission current Ic is kept constant may be different for each current level.

Figure 7:
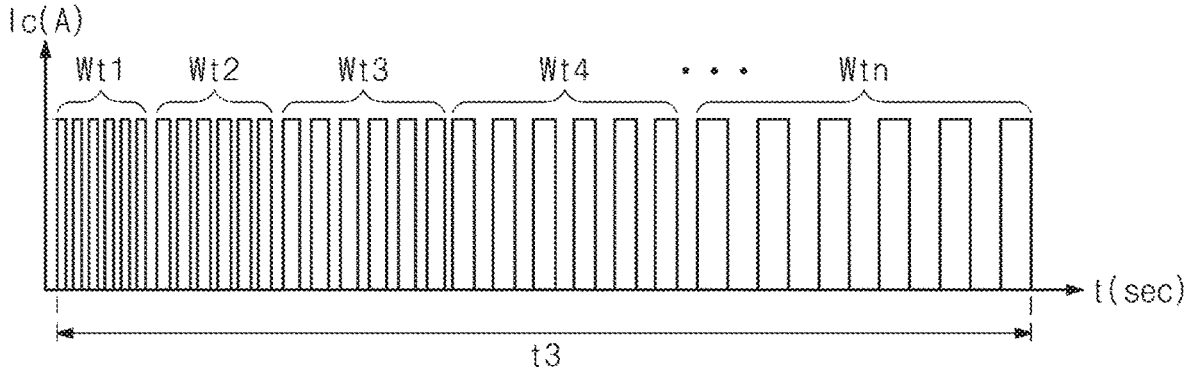
FIG. 7 is a graph showing another embodiment of the field emission current generated during the third time of FIG. 5.

FIG. 7 is a graph showing another embodiment of the field emission current generated during the third time of FIG. 5. The horizontal axis is defined as a time, and the vertical axis is defined as the magnitude of the field emission current Ic. Referring to FIG. 7, the pulse width of the field emission current Ic may sequentially increase up to the first to n-th pulse widths Wt1 to Wtn during the third time t3. Here, the first pulse width Wt1 corresponds to the pulse width of the field emission current Ic in the second time t2, and the n-th pulse width Wtn corresponds to the target pulse width Wt in FIG. 5. Unlike FIG. 5, the magnitude of the pulse width may be repeatedly maintained for a certain number of times (reference number of times). For example, even if the pulse width of the field emission current Ic is increased by the reference width thereafter, the reference number of times may be the sufficient number of repetitions of the peak value with which the field emission device FED is not permanently broken.

The pulse width of the field emission current Ic may be increased by the first reference width after maintaining the same pulse width for a constant time. The first reference width may be greater than the reference width of FIG. 5. After the pulse width of the field emission current Ic is increased by the first reference width, the pulse width may be again maintained for a constant time, and may be increased again by the second reference width. That is, the pulse width may be increased stepwise up to the n-th pulse width Wtn which is the target pulse width. The first reference width and the second reference width may be equal to each other, but the inventive concept is not limited thereto, and may be set to different sizes in consideration of the possibility of permanent damage of the field emission device FED. In addition, the reference number of times that the pulse width of the field emission current Ic is kept constant may be different according to the magnitude of the pulse width.

Figure 8:
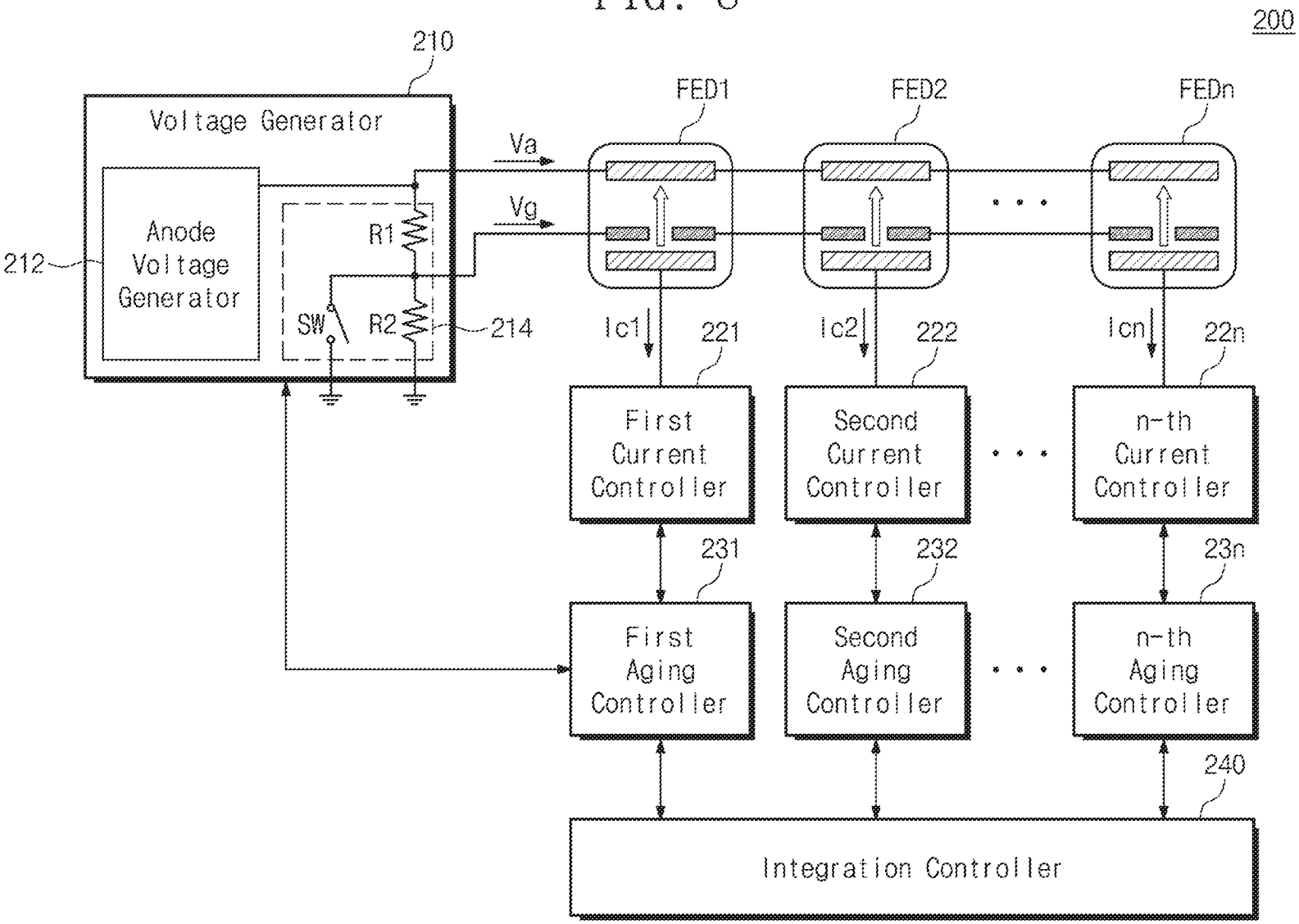
FIG. 8 is a block diagram of an apparatus for aging a plurality of field emission devices according to an embodiment of the inventive concept.

FIG. 8 is a block diagram of an apparatus for aging a plurality of field emission devices according to an embodiment of the inventive concept. Referring to FIG. 8, a field emission device aging apparatus 200 may include a voltage generator 210, first to n-th current controllers 221 to 22*n*, first to n-th aging controllers 231 to 23*n*, an integration controller 240. The field emission device aging apparatus 200 may simultaneously age the first to n-th field emission devices FED1 to FEDn in parallel. Therefore, the aging time for mass production of field emission devices may be reduced, and low-cost high-efficiency aging is possible.

The voltage generator 210 may include an anode voltage generator 212 and a gate voltage generator 214. The anode voltage generator 212 may generate an anode voltage Va that sequentially increases to the target voltage level during voltage aging. The anode voltage generator 212 may generate an anode voltage Va having a target voltage level during field emission current aging, field emission time aging, and final condition aging. The anode voltage Va may be provided in parallel to each of the first to n-th field emission devices FED1 to FEDn.

The gate voltage generator 214 may generate a gate voltage Vg having a voltage level lower than the target anode voltage level during field emission current aging, field emission time aging, and final condition aging. The gate voltage Vg may be provided in parallel to each of the first to n-th field emission devices FED1 to FEDn. Illustratively, the gate voltage generator 214 may include a first resistor R1 and a second resistor R2. The gate voltage generator 214 may generate the gate voltage Vg by dividing the anode voltage Va using the first resistor R1 and the second resistor R2. However, the inventive concept is not limited thereto, and the gate voltage generator 214 may be configured to generate the gate voltage Vg separately from the anode voltage Va.

The gate voltage generator 214 may further include a switch SW for shorting the cathode electrode and the gate electrode included in each of the first to n-th field emission devices FED1 to FEDn during the voltage aging. During voltage aging, the switch SW may be turned on to ground the gate electrodes. At the same time, each of the first to n-th current controllers 221 to 22*n* grounds the cathode electrodes, thereby shorting the gate electrode and the cathode electrode to each other. After the voltage aging, the switch SW is turned off, and the anode voltage Va is divided by the first resistor R1 and the second resistor R2, so that the gate voltage Vg may be generated.

Unlike those shown, the voltage generator 210 may include a cathode voltage generator instead of the anode voltage generator 212. In this case, the anode electrodes of the first to n-th field emission devices FED1 to FEDn may be grounded. During voltage aging, the cathode electrode and the gate electrode may be circuit-shorted and the cathode voltage generator may generate a cathode voltage that increases (absolute value) sequentially to a negative target voltage level. The cathode voltage may be applied to the cathode electrode and the gate electrode during voltage aging. After voltage aging, the cathode electrode and the gate electrode may electrically separated, a cathode voltage having a target voltage level may be applied to the cathode electrode, and the gate voltage Vg may be applied to the gate electrode.

The first to n-th current controllers 221 to 22*n* control the first to n-th field emission currents Ic1 to Icn generated by the first to n-th field emission devices FED1 to FEDn. During the field emission current aging, the first to the n-th current controllers 221 to 22*n* may control the first to n-th field emission devices FED1 to FEDn such that the first to n-th field emission currents Ic1 to Icn to sequentially increase to the target current level. During the field emission time aging, the first to the n-th current controllers 221 to 22*n* may control the first to n-th field emission devices FED1 to FEDn such that the first to n-th field emission currents Ic1 to Icn sequentially increase to the target pulse width. During the final condition aging, the first to the n-th current controllers 221 to 22*n* may control the first to n-th field emission devices FED1 to FEDn such that such that the first to n-th field emission currents Ic1 to Icn maintain the target current level and the target pulse width.

The first to n-th aging controllers 231 to 23*n* may control the operations of the first to n-th current controllers 221 to 22*n*, respectively. The first to n-th aging controllers 231 to 23*n* may control voltage aging, field emission current aging, field emission time aging, and final condition aging operations. For example, the second aging controller 232 may compare the level of the second field emission current Ic2 measured by the second current controller 222 with the target current level, or compare the pulse width with the target pulse width. The second aging controller 232 may control the second current controller 222 to increase the level or pulse width of the second field emission current Ic2 or change the aging operation based on the comparison result.

The first aging controller 231 may further control the operation of the voltage generator 210, unlike other aging controllers. However, the inventive concept is not limited to this, and one of the second to n-th aging controllers 232 to 23*n* may control the voltage generator 210. Since the voltage generator 210 provides the anode voltage Va and the gate voltage Vg to the first to n-th field emission devices FED1 to FEDn in parallel, for the control of the voltage generator 210, one aging controller may be sufficient. However, the inventive concept is not limited thereto, and a separate controller for controlling the voltage generator 210 may be further provided.

The first aging controller 231 compares the level of the measured anode voltage Va with the target voltage level and controls the voltage generator 210 to increase the level of the anode voltage Va or to change the aging operation. The first aging controller 231 may provide a voltage control signal for controlling the on/off of the switch SW to the voltage generator 210. During voltage aging, the first aging controller 231 may turn on the switch SW, and at the end of the voltage aging, the first aging controller 231 may turn off the switch SW.

Each of the first to n-th aging controllers 231 to 23*n* may be implemented using a computing device. The first to n-th aging controllers 231 to 23*n* may be implemented using a programmable computing device for receiving the measured voltage or current of each of the first to n-th field emission devices FED1 to FEDn and for controlling the aging operation based on the received voltage or current. The first to n-th aging controllers 231 to 23*n* may include a CPU, memory, and bus, such as the aging controller 130 described above with reference to FIG. 1. For example, the first to n-th aging controllers 231 to 23*n* may be implemented using a single board computer such as Arduino, Raspberry, and the like.

The integration controller 240 may integrally control the first to the n-th aging controllers 231 to 23*n*. The integration controller 240 may determine a control variable that changes at a later time according to the level and the pulse width of each of the anode voltage V and the first to n-th field emission currents Ic1 to Icn. The control variables may be stored in the integration controller 240 in advance. For example, the first to n-th aging controllers 231 to 23*n* may receive information on the level and pulse width of each of the anode voltage Va and the first to n-th field emission currents Ic1 to Icn, and may provide the control variables that are changed based on the received information to the first to n-th aging controllers 231 to 23*n*. The first to n-th aging controllers 231 to 23*n* may control the voltage generator 210 and the first to n-th current controllers 221 to 22*n* based on the received control variables.

The integration controller 240 may be implemented using a computing device and may communicate with the first to the nth aging controllers 231 to 23*n* in a wired or wireless manner The integration controller 240 may include a CPU for processing information for integrated control of the first to n-th aging controllers 231 to 23*n*, a memory for storing such information, and a bus for transferring information between the CPU and the memory.

Figure 9:
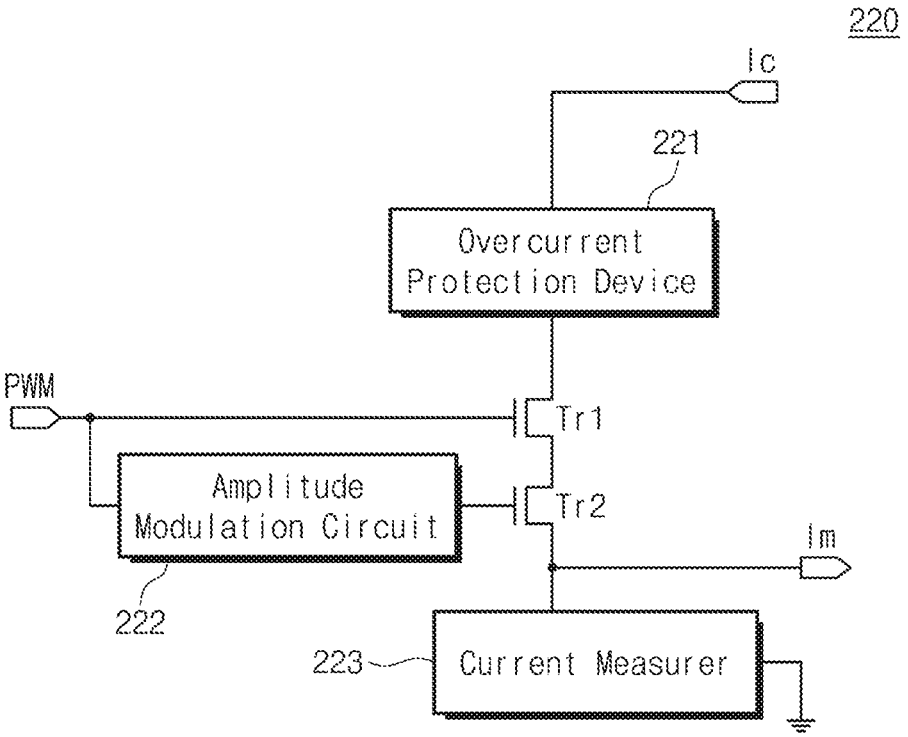
FIG. 9 is a view for explaining an exemplary structure of the current controllers of FIG. 8.

FIG. 9 is a view for explaining an exemplary structure of the current controllers of FIG. 8. The current controller 220 of FIG. 9 may be seen as one of the first to n-th current controllers 221 to 22*n* of FIG. 8. However, the current controller 220 will be understood as an embodiment of the structure of the first to n-th current controllers 221 to 22*n* of FIG. 8, and the structure of the first to n-th current controllers 221 to 22*n* will not be limited thereto. Referring to FIG. 9, the current controller 220 includes an overcurrent protection element 221, an amplitude modulation circuit 222, a current measurer 223, a first transistor Tr1, and a second transistor Tr2.

If the magnitude of the field emission current Ic has an overcurrent that causes damage to the current controller 220 or the field emission device, the overcurrent protection element 221 may be configured to block the electrical connection between the field emission device and the current controller 220. The overcurrent protection element 221 is disposed between the cathode electrode of the field emission device and the first transistor Tr1. For example, the overcurrent protection element 221 may include a fuse.

The amplitude modulation circuit 222 may generate an amplitude modulation signal by modulating the amplitude of the pulse width modulation signal PWM. The amplitude modulation circuit 222 may determine the amplitude of the amplitude modulation signal under the control of the aging controller. For example, during field emission current aging, the amplitude modulation circuit 222 may modulate the amplitude of the pulse width modulation signal PWM) to have an increasing amplitude over time. The amplitude modulation signal may be provided to the gate of the second transistor Tr2. The second transistor Tr2 may adjust the peak value of the field emission current Ic based on the amplitude modulation signal. However, the inventive concept is not limited thereto, and the signal provided to the gate of the second transistor Tr2 may be a DC signal generated under the control of the aging controller separately from the signal provided to the gate of the first transistor Tr1.

The first transistor Tr1 may determine the pulse width (period and duty) of the field emission current based on the first control signal. The first control signal may be a pulse width modulation signal PWM. A pulse width modulation signal PWM may be provided from the aging controller. The first transistor Tr1 and the first control signal are substantially the same as the first transistor Tr1 and the first control signal in FIG. 4, and thus a detailed description thereof will be omitted.

The second transistor Tr2 may determine the level (peak value and amplitude) of the field emission current based on the second control signal. The second control signal may be an amplitude modulation signal generated by the amplitude modulation circuit 222. The second transistor Tr2 and the second control signal are substantially the same as the second transistor Tr2 and the second control signal in FIG. 4, and thus a detailed description thereof will be omitted.

The current measurer 223 may be configured to measure the field emission current Ic. The current measurer 223 may be disposed between the second transistor Tr2 and ground. The current measurer 223 may include a resistor for transmitting the measurement current Im, which classifies a part of the field emission current Ic, to the aging controller. A part of the field emission current Ic may be provided to the aging controller by a resistor included in the current measurer 223.

Figure 10:
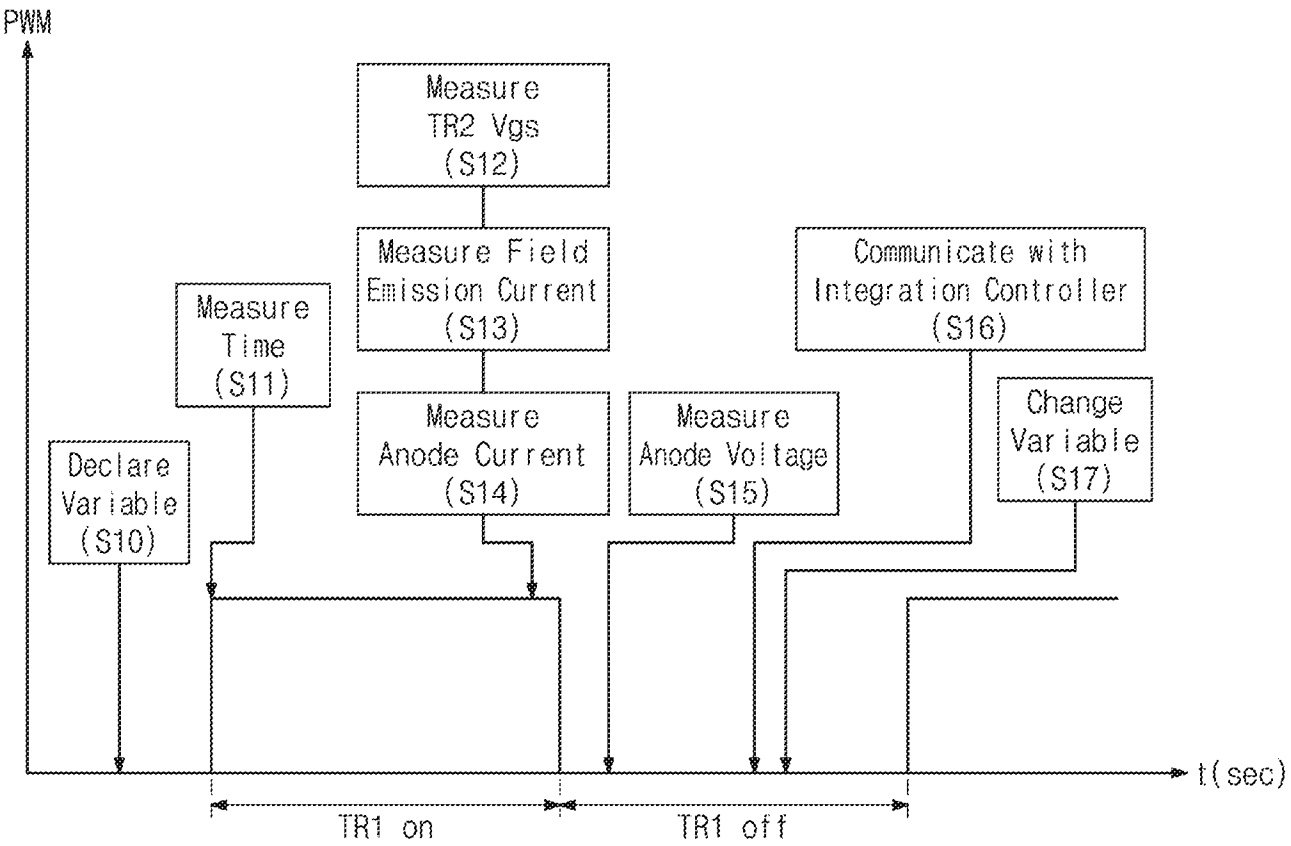
FIG. 10 is a view for explaining an exemplary operation of the aging controllers of FIG. 8.

FIG. 10 is a view for explaining an exemplary operation of the aging controllers of FIG. 8. The aging controller for performing the operation of FIG. 10 may be one of the first to n-th aging controllers 231 to 23*n* of FIG. 8. However, the operations of FIG. 10 will be understood as an embodiment of the operation of the first to n-th aging controllers 231 to 23*n* of FIG. 8, and FIG. 8 will not be limited to the operation of FIG. 10. For example, the order of steps S10 to S17 may be changed, and the progress time of each step may be different from that of FIG. 10. In the graph of FIG. 10, the horizontal axis is defined as time, and the vertical axis is defined as the magnitude of the pulse width modulation signal PWM generated from the aging controller. For convenience of explanation, referring to the reference numerals of FIG. 9, FIG. 10 will be described.

The pulse width modulation signal PWM may determine the on/off state of the first transistor Tr1, as described above with reference to FIG. 9. Illustratively, when the pulse width modulation signal PWM is at a high level, the first transistor Tr1 is turned on, and when the pulse width modulation signal PWM is at a low level, the first transistor Tr1 is turned off. During the voltage aging, the gate electrode and the cathode electrode of the field emission device are short-circuited and grounded, so that the field emission current Ic may not be generated. However, according to the operation of the pulse width modulation signal PWM, the first aging controller 231 of FIG. 8 may control the voltage generator 210 and the anode voltage Va may be generated. During field emission current aging, the pulse width modulation signal PWM may have a constant period. However, the level of the field emission current Ic may be sequentially increased by the amplitude modulation circuit 222.

During field emission time aging, the time at which the pulse width modulation signal PWM has a high level may be sequentially increased. That is, the time at which the first transistor Tr1 is turned on sequentially increases, and the pulse width of the field emission current Ic may be sequentially increased. The time at which the pulse width modulation signal PWM has a high level may increase until the time corresponding to the target pulse width. However, the level of the field emission current Ic may be kept constant. During final condition aging, the time at which the pulse width modulation signal PWM has a high level may be maintained at the target pulse width.

Operation S10 is performed before the pulse width modulation signal PWM has a rising edge. In operation S10, the integration controller 240 of FIG. 6 determines the control variable, and the aging controller may declare the control variable. Based on the declared control variable, the period and pulse width of the pulse width modulation signal PWM may be determined. Further, based on the control variable, the magnitude of the amplitude modulated by the amplitude modulation circuit 222 may be determined.

Operation S11 may be performed when the pulse width modulation signal PWM has a rising edge. In operation S11, the aging controller measures time. The time is measured up to the next rising edge of the pulse width modulation signal PWM. That is, the aging controller may control the period and the pulse width of the pulse width modulation signal PWM by measuring the time interval at which the rising edge occurs. Illustratively, for time measurement, the aging controller may include a counter.

Operation S12 may be performed before the pulse width modulation signal PWM has a falling edge. In operation S12, the aging controller measures the gate-source voltage of the second transistor Tr2. However, if the gate-source voltage of the second transistor Tr2 is a constant DC signal with respect to time regardless of the signal inputted to the first transistor Tr1, operation S12 may be performed after the pulse width modulation signal PWM has a falling edge. The gate-source voltage of the second transistor Tr2 may refer to a second control signal and may refer to the amplitude modulation signal generated by the amplitude modulation circuit 222. Since the level of the field emission current Ic determined by the second control signal is significant when the first transistor Tr1 is turned on, when the pulse width modulation signal PWM has a high level, the gate-source voltage of the second transistor Tr2 may be measured.

Operations S13 and S14 may be performed before the pulse width modulation signal PWM has a falling edge. In operation S13, the aging controller measures the field emission current Ic. The magnitude of the field emission current Ic may depend on the second control signal, i.e., the gate-source voltage of the second transistor Tr2. In operation S14, the aging controller may measure the anode current flowing through the anode electrode of the field emission device. In order to increase the measurement accuracy of the field emission current Ic or the anode current, operations S13 and S14 may be measured at least once at any time while the first transistor Tr1 is turned on. For convenience of description, operations S12 to S14 are shown as being performed at the same time, it will be understood that each of the operations S12 to S14 in practice may be performed at a different arbitrary time point while the first transistor Tr1 is turned on.

Operation S15 may be performed after the pulse width modulation signal PWM has a falling edge. In operation S15, the aging controller may measure the anode voltage applied to the anode electrode of the field emission device.

Operation S16 may be performed after operations S12 to S15 are performed. In operation S16, the aging controller may communicate with the integration controller 240 of FIG. 6. The aging controller may transmit information on the voltage and current measured in operations S12 to S15 to the integration controller 240. The integration controller 240 may determine the changed control variable based on the received information. The integration controller 240 may transmit information on the determined control variable to the aging controller.

Operation S17 may be performed after operation S16. Operation S17 corresponds to operation S10. In operation S17, the aging controller may change the control variable based on the control variable received from the integration controller 240. For example, the aging controller may change the control variable to increase the level of the anode voltage in the voltage aging step. The aging controller may change the control variable so as to increase the level of the field emission current in the field emission current aging step. The aging controller may change the control variable so as to increase the pulse width of the field emission current in the field emission time aging step.

Figure 11:
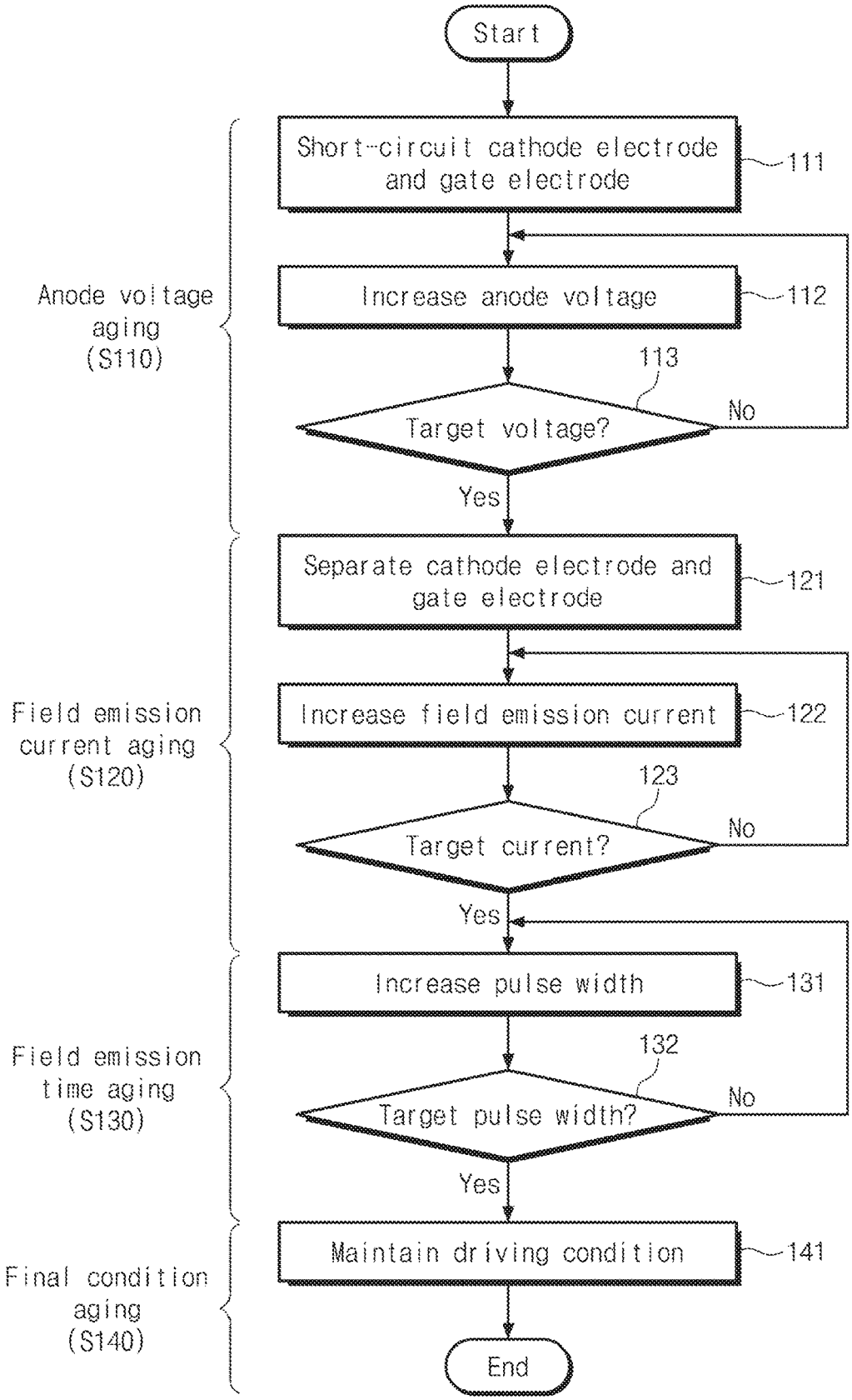
FIG. 11 is a flowchart illustrating an aging method of a field emission device aging apparatus according to an embodiment of the inventive concept.

FIG. 11 is a flowchart illustrating an aging method of a field emission device aging apparatus according to an embodiment of the inventive concept. The method of FIG. 11 may be performed in the apparatus 100 of FIG. 1 or the apparatus 200 of FIG. 8. Referring to FIG. 11, an aging method of a field emission device aging apparatus may include operation S110 of aging the anode voltage, operation S120 of aging the field emission current, operation S130 of aging the field emission time, and operation S140 of aging the final condition. For convenience of description, FIG. 11 is described with reference to FIG. 1.

The cathode electrode CA and the gate electrode GA are short-circuited under the control of the aging controller 130 in operation S111 of operation S110. For example, the voltage generator 110 may short-circuit the cathode electrode CA and the gate electrode GA. This prevents an instantaneous increase in potential difference between the cathode electrode CA and the gate electrode GA during arc discharge, thereby preventing damage to the emitter.

In operation S112 of operation S110, the voltage generator 110 may increase the level of the anode voltage Va. In operation S113 of operation S110, the aging controller 130 may determine whether the level of the increased anode voltage reaches the target voltage level. If the level of the anode voltage Va does not reach the target voltage level, operation S112 proceeds and the voltage generator 110 increases the level of the anode voltage Va again. If the level of the anode voltage Va reaches the target voltage level as a result of the repetition of operations S112 and S113, operation S120 is performed.

The cathode electrode CA and the gate electrode GA are electrically separated under the control of the aging controller 130 in operation S121 of operation S120. For example, the voltage generator 110 may separate the cathode electrode CA and the gate electrode GA, and apply the gate voltage Vg to the gate electrode GA. Also, the voltage generator 110 may apply an anode voltage Va having a target voltage level to the anode electrode AN. Due to this, a field emission current Ic may flow through the field emission device FED.

In operation S122 of operation S120, the current controller 120 may increase the field emission current Ic. In operation S123 of operation S120, the aging controller 130 may determine whether the level of the increased field emission current Ic reaches the target current level. If the level of the field emission current Ic does not reach the target current level, operation S122 proceeds, and the current controller 120 increases the level of the field emission current Ic again. If the level of the field emission current Ic reaches the target current level as a result of the repetition of operations S122 and S123, operation S130 is performed.

In operation S131 of operation S130, the current controller 120 may increase the pulse width of the field emission current Ic. In operation S132 of operation S130, the aging controller 130 may determine whether the pulse width of the increased field emission current Ic reaches the target pulse width. If the pulse width of the field emission current Ic does not reach the target pulse width, operation S131 proceeds, and the current controller 120 increases the pulse width of the field emission current Ic again. If the pulse width of the field emission current Ic reaches the target pulse width as a result of the repetition of operations S131 and S132, operation S140 is performed.

In operation S141 of operation S140, the driving condition of the field emission device FED is maintained. The voltage generator 110 applies an anode voltage Va having a target voltage level to the anode electrode AN, and the current controller 120 has the target current level and may control the field emission current Ic to have the target pulse width. If the characteristic of the field emission device FED satisfies the reference characteristic suitable for performing the unique operation, the method ends. If the characteristics of the field emission device (FED) do not satisfy the reference characteristic, operations S110 to S140 may be repeated or an individual aging step may be performed.

Operations S110 to S140 of FIG. 11 will be understood as an example, and the order of operations S110 to S140 may be changed according to the characteristics of the field emission device aging apparatus 100. For example, after operation S120 is performed, operation S110 may be performed.

The above described content is a concrete example for carrying out the inventive concept.

A field emission device aging apparatus and aging method thereof according to an embodiment of inventive concept may improve the performance of a large number of field emission devices with high efficiency and low cost by optimizing the order of aging voltage, aging the field emission current, aging the field emission time, and aging with final condition.

Although the exemplary embodiments of the inventive concept have been described, it is understood that the inventive concept should not be limited to these exemplary embodiments but various changes and modifications can be made by one ordinary skilled in the art within the spirit and scope of the inventive concept as hereinafter claimed.

What is claimed is:

1. An apparatus for aging a field emission device configured to emit electrons based on an electric field between a first electrode and a second electrode of the field emission device, the apparatus comprising:

a voltage generator configured to increase a voltage applied to the first electrode of the field emission device to a target voltage level during a first time; and a current controller configured to increase a field emission current of the field emission device to a target current level during a second time after the first time and increase a pulse width of the field emission current having the target current level to a target pulse width during a third time after the second time.

2. The apparatus of claim 1, wherein the voltage generator further generates a gate voltage applied to a gate electrode of the field emission device for adjusting an electron emission amount after the first time.

3. The apparatus of claim 2, wherein the voltage generator short-circuits the second electrode and the gate electrode during the first time, and the first electrode is an anode electrode, and the second electrode is a cathode electrode.

4. The apparatus of claim 2, wherein the voltage generator short-circuits the first electrode and the gate electrode during the first time, and the first electrode is a cathode electrode, and the second electrode is an anode electrode.

5. The apparatus of claim 1, wherein the current controller interrupts a flow of the field emission current during the first time and controls the field emission current to have an initial aging pulse width less than the target pulse width and have a peak value that increases to the target current level during the second time.

6. The apparatus of claim 5, wherein the current controller increases the pulse width of the field emission current in a logarithmic scale from the initial aging pulse width to the target pulse width during the third time.

7. The apparatus of claim 1, wherein the current controller increases a peak value of the field emission current to the target current level during the second time and controls the field emission current such that the peak value is repeated at least once at a same value.

8. The apparatus of claim 1, wherein the current controller increases the pulse width of the field emission current to the target pulse width during the third time and controls the field emission current so that the pulse width is repeated at least once at a same width.

9. The apparatus of claim 1, wherein the voltage generator applies the voltage having the target voltage level to the first electrode during a fourth time after the third time, and the current controller controls the field emission current so that a peak value is maintained at the target current level and the pulse width is maintained at the target pulse width during the fourth time.

10. The apparatus of claim 1, wherein the current controller comprises:

a first transistor configured to determine the pulse width of the field emission current based on a first control signal;

a second transistor configured to determine a peak value of the field emission current based on a second control signal;

a function generator configured to provide the first control signal to a gate of the first transistor and to provide the second control signal to a gate of the second transistor; and a current measurer configured to measure the field emission current.

11. The apparatus of claim 1, further comprising an aging controller for controlling the voltage generator and the current controller, wherein the aging controller controls the voltage generator to sequentially increases the voltage applied to the first electrode to the target voltage level for the first time and to maintain the target voltage level after the first time; and controls the current controller to sequentially increase a peak value of the field emission current to the target current level during the second time, controls the current controller to sequentially increase the pulse width of the field emission current to the target pulse width during the third time, and controls the current controller to have the peak value of the target current level and to have the target pulse width during the fourth time after the third time.

12. The apparatus of claim 11, further comprising:

a second current controller for controlling a second field emission current of a second field emission device that emits electrons based on an electric field between a third electrode and a fourth electrode, increasing a peak value of a second field emission current to the target current level during the second time, and increasing a pulse width of the second emission current to the target pulse width during the third time; and a second aging controller for controlling the second current controller, wherein the voltage generator increases a voltage applied to the third electrode to the target voltage level during the first time.

13. The apparatus of claim 12, further comprising an integration controller for determining a control variable of the aging controller and the second aging controller based on the field emission current, the second field emission current, and the voltage applied to the first and third electrodes, wherein the aging controller and the second aging controller determine the peak value and the pulse width of each of the field emission current and the second field emission current based on the control variable.

14. A method of aging a field emission device, the method comprising:

sequentially increasing a voltage applied to a first electrode of the field emission device to a target voltage level during a first time;

maintaining the voltage at the target voltage level after the first time;

sequentially increasing a field emission current of the field emission device to a target current level during a second time after the first time;

sequentially increasing a pulse width of the field emission current having the target current level to a target pulse width during a third time after the second time; and controlling the field emission current to maintain the target current level and the target pulse width during a fourth time after the third time.

15. The method of claim 14, wherein sequentially increasing the voltage to the target voltage level comprises:

short-circuiting a second electrode and a gate electrode of the field emission device;

increasing the voltage by a reference voltage level; and determining whether the voltage reaches the target voltage level.

16. The method of claim 15, wherein sequentially increasing the field emission current to the target current level comprises:

electrically isolating the second electrode from the gate electrode;

increasing a peak value of the field emission current by a reference current level; and determining whether the field emission current reaches the target current level.

17. The method of claim 14, wherein sequentially increasing the pulse width of the field emission current to the target pulse width comprises:

increasing the pulse width by a reference width; and determining whether the pulse width reaches the target pulse width.

* * * * *